US009650771B2

(12) United States Patent
Shinohara et al.

(10) Patent No.: US 9,650,771 B2
(45) Date of Patent: May 16, 2017

(54) FLUSH WATER VOLUME REGULATOR, FLUSH WATER TANK APPARATUS COMPRISING SAID FLUSH WATER VOLUME REGULATOR, AND FLUSH TOILET COMPRISING SAID FLUSH WATER TANK

(71) Applicant: TOTO LTD., Fukuoka (JP)

(72) Inventors: Koki Shinohara, Kitakyushu (JP); Hideki Tanimoto, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 277 days.

(21) Appl. No.: 14/479,569

(22) Filed: Sep. 8, 2014

(65) Prior Publication Data

US 2015/0082530 A1 Mar. 26, 2015

(30) Foreign Application Priority Data

Sep. 24, 2013 (JP) ..... 2013-197056

(51) Int. Cl.
*E03D 1/35* (2006.01)
*E03D 1/14* (2006.01)
*E03D 1/22* (2006.01)

(52) U.S. Cl.
CPC ..... *E03D 1/14* (2013.01); *E03D 1/22* (2013.01)

(58) Field of Classification Search
CPC ..... E03D 1/14; E03D 1/141; E03D 1/142; E03D 1/22; E03D 1/33; E03D 1/34; E03D 1/35; E03D 1/304
USPC ..... 4/363, 395
See application file for complete search history.

(56) References Cited

U.S. PATENT DOCUMENTS 2,018,036 A * 10/1935 Schmiedeknecht ..... E03D 1/304 4/331
2,077,832 A * 4/1937 Gebert ..... E03D 1/34 4/391
5,249,314 A * 10/1993 Sweeny ..... E03D 1/14 4/227.1
2008/0034488 A1* 2/2008 Lusch ..... E03D 1/14 4/324
2010/0058524 A1* 3/2010 Wajda ..... E03D 1/22 4/326
2011/0289669 A1* 12/2011 Hennessy ..... E03D 1/142 4/328

(Continued)

FOREIGN PATENT DOCUMENTS

JP H05-087070 U 11/1993

*Primary Examiner* — J. Casimer Jacyna
(74) *Attorney, Agent, or Firm* — Studebaker & Brackett PC

(57) ABSTRACT

A flush water volume regulator is provided, capable of canceling the buoyancy force acting on a water reservoir, wherein flush water in the water reservoir can be circulated with flush water in a flush water tank outside the water reservoir. The flush water volume regulator of the present invention has a water reservoir capable of holding a predetermined amount of flush water, having a water reservoir in which an opening is formed through which flush water inside water reservoir and flush water outside water reservoir can flow, and a float prevention means for causing a force to act on water reservoir in the opposite direction to the buoyancy force produced by flush water on water reservoir in flush water tank when water supply apparatus is supplying water into flush water tank.

8 Claims, 9 Drawing Sheets

(56) References Cited

U.S. PATENT DOCUMENTS

2012/0174307 A1* 7/2012 Wang ..... E03D 1/34
4/370

* cited by examiner

FLUSH WATER VOLUME REGULATOR, FLUSH WATER TANK APPARATUS COMPRISING SAID FLUSH WATER VOLUME REGULATOR, AND FLUSH TOILET COMPRISING SAID FLUSH WATER TANK

TECHNICAL FIELD

The present invention pertains to a flush water volume regulator, a flush water tank apparatus comprising said flush water volume regulator, and a flush toilet comprising said flush water tank, and in particular to a flush water volume regulator mounted on a flush water tank apparatus, capable of regulating the volume of flush water discharged to a toilet, and to a flush water tank apparatus comprising said flush water volume regulator, and to a flush toilet comprising said flush water tank.

BACKGROUND ART

With the growing demand in recent years for water conservation, the problem has arisen that in tank-type toilets, the reduction in the amount of flush water used to flush toilets has caused a drop in the water level head of flush water held in flush water tanks, weakening the force of flush water discharged from flush water tanks.

A known response to this issue has been to provide a water conserving tank in which flush water can be stored inside the flush water tank for supplying flush water to a toilet so as to cut the amount of flush water used in a single toilet flush without reducing the water level head, as set forth in Patent Document 1 (Specification of Unexamined Utility Model Application H05-87070), for example. Provided at the bottom of the side surface of this water conserving tank are a water discharge port for discharging flush water from the water conserving tank into the flush water tank when the interior of the flush water tank becomes empty, and an intake port at the top end of the side surface of the water conserving tank for intaking flush water into the water conserving tank, so that water can be exchanged to prevent water in the water conserving tank from stagnating.

SUMMARY OF INVENTION

Technical Problem

However, in a conventional water conserving tank such as that described in Patent Document 1, after the start of a flush the water level inside the flush water tank drops, and water inside the water conserving tank is discharged from a water discharge opening. When supplying water to the tank after completion of a discharge operation, the problem occurs that the level of water stored in the flush water tank becomes higher than the level of water in the water conserving tank, producing a water level differential, such that the water conserving tank floats upward and separates from its attachment position.

Also, in conventional water conserving tanks of the type described in Patent Document 1, the water conserving tank flush water intake port is placed at the top end of the side surface. Therefore when water is first supplied to an empty water conserving tank, such as during installation, or when a user holds the flush lever at operated location for a long time period, a water level differential arises whereby the level of water stored inside the flush water tank rises above the level of water inside the water conserving tank, and the water conserving tank receives a buoyancy force and floats upward, with the resultant problem that it separates from its attachment position.

The present invention was undertaken to solve the above-described problems with the conventional art, and has the object of providing a flush water volume regulator capable of canceling the occurrence of a buoyancy force acting on the water reservoir, and capable of circulating flush water inside the water reservoir with flush water inside the flush water tank outside the water reservoir.

Means for Resolving Problems

In order to accomplish the above objective, the present invention is a flush water volume regulator capable of adjusting the volume of flush water discharged to a toilet, disposed on a flush water tank apparatus having a water supply apparatus for supplying flush water for flushing a toilet from a water source into a flush water tank, and a discharge valve apparatus for opening and closing a discharge water pathway disposed on the bottom surface of a flush water tank and communicating with the toilet, whereby the flush water volume regulator has: a water reservoir, being a water reservoir disposed inside this flush water tank and capable of holding a predetermined amount of flush water, wherein an opening is formed through which flush water inside the water reservoir and flush water outside the water reservoir can flow; and a floatation prevention means extending from the water reservoir, for applying a force to the water reservoir in the opposite direction of the buoyancy force produced on the water reservoir by flush water in the flush water tank when the water supply apparatus is supplying water into the flush water tank.

In the invention thus constituted, the flotation prevention means causes a force to act on the water reservoir in the opposite direction to the buoyancy force produced on the water reservoir by flush water in the flush water tank when the water supply apparatus is supplying water into the flush water tank. Therefore the buoyancy force acting on the water reservoir can be canceled, and the problem whereby the water reservoir receives a buoyancy force and causing it to float up and separate from its attachment position can be prevented. Also, in the present invention the opening formed in the water reservoir is constantly released, so flush water in the water reservoir can be circulated with flush water inside the tank located outside the water reservoir. Therefore in the present invention a flush water volume regulator can be provided which is capable of canceling the buoyancy force acting on a water reservoir, and flush water in the water reservoir can be circulated with flush water in a flush water tank outside the water reservoir.

In the present invention a float prevention means preferably comprises a top surface portion placed to extend from the water reservoir and capable of contacting the downward facing surface of a water supply apparatus or discharge valve apparatus.

In the invention thus constituted, when the water supply apparatus supplies water into the flush water tank, the ability for the downward facing surface of an existing water supply apparatus or discharge valve apparatus to contact the top surface portion of a float prevention means disposed to extend from the water reservoir enables the buoyancy force acting on the water reservoir to be canceled, so that the problem of the water reservoir floating up and separating from its position of attachment can be prevented using a relatively simple structure, without providing any special member. Also, in the present invention the opening formed in the water reservoir is constantly released, so flush water in the water reservoir can be circulated with flush water inside the tank located outside the water reservoir. Therefore in the present invention a flush water volume regulator can be provided which is capable of canceling the buoyancy force acting on a water reservoir, and flush water in the water reservoir can be circulated with flush water in a flush water tank outside the water reservoir.

In the present invention preferably the discharge valve apparatus comprises an overflow pipe for discharging flush water into a discharge flow path when flush water accumulated in the flush water tank exceeds the full water level, and the top surface portion of a float prevention means is disposed between the downward facing surface of an overflow pipe and the bottom surface of a flush water tank, so as to be able to contact the downward facing surface of the overflow pipe.

In the invention thus constituted, the dead space between the downward facing surface of the overflow pipe and the bottom surface of the tank can be effectively used to efficiently dispose the float prevention means within the limited space inside the flush water tank. When a water supply apparatus is supplying water into the flush water tank, the downward facing surface of the overflow pipe can contact the top surface portion of the float prevention means placed so as to extend from the water reservoir. The buoyancy force acting on the water reservoir can thus be canceled, and the problem whereby the water reservoir floats up and separates from its attachment position can be reliably prevented.

In the present invention the float prevention means preferably comprises a side wall portion rising from the two sides of the top surface portion, and the cross section formed by the top surface portion and the side wall portions is shaped as an "U".

In the present invention thus constituted, the float prevention means comprises a side wall portion rising from the two sides of the top surface portion, and the cross section formed by the top surface portion and the side wall portions is shaped as the "U". Therefore the strength of the float prevention means against loads can be increased, and sideways movement of the float prevention means relative to the overflow pipe can be prevented.

In the present invention the water reservoir preferably comprises a load support member for supporting the load of the water reservoir at a position at the center of gravity on the bottom surface of the water reservoir, and the water reservoir is disposed so that its side surface contacts the side surface of the overflow pipe.

In the invention thus constituted, the load support member supports the load of the water reservoir, stably supporting the water reservoir, and the water reservoir is disposed with its side surface contacting the side surface of the overflow pipe, therefore the water reservoir can be stably affixed even if undulations occur in the flush water inside the flush water tank.

In the present invention an opening is preferably formed on the bottom surface of the water reservoir.

In the invention thus constituted, an opening is formed at the bottom surface of the water reservoir, therefore buoyancy forces acting on the water reservoir can be constrained by reducing the surface area of the bottom surface, and the problem of the water reservoir being subjected to buoyancy force and floating up and separating from the position of attachment can be prevented from occurring.

In the invention thus constituted, the water reservoir is preferably formed so that the top edge of the side surface of the water reservoir is positioned a predetermined distance above the expected full water level inside the flush water tank in a standby state before a flush is started, and the bottom edge of the side surface of the water reservoir is positioned a predetermined distance below the expected dead water level of flush water inside the flush water tank immediately after completion of a toilet flush.

In the invention thus constituted, the top edge of the water reservoir side surface is positioned a predetermined distance above the expected full water level, and the bottom edge of the water reservoir side surface is positioned a predetermined distance below the expected dead water level. Hence even when the full water level fluctuates up and down, the full water level is disposed between the top edge and bottom edge of the side surface of water reservoir, and even when the dead water level fluctuates up and down, the dead water level is disposed between the top edge and bottom edge of the side surface of the water reservoir. Therefore the present invention enables reliable regulation of the expected volume of flush water.

Next, the present invention is a flush water tank apparatus comprising a flush water volume regulator.

In the invention thus constituted, a flush water tank apparatus can be provided comprising a flush water volume regulator capable of canceling the buoyancy force acting on a water reservoir, and flush water in the water reservoir can be circulated with flush water in a flush water tank located outside the water reservoir.

Next, the present invention is a flush toilet comprising a flush water tank apparatus.

In the invention thus constituted, a flush toilet can be provided having a flush water tank apparatus comprising a flush water volume regulator capable of canceling the buoyancy force acting on a water reservoir, and flush water in the water reservoir can be circulated with flush water in a flush water tank outside the water reservoir.

Effect of the Invention

According to the flush water volume regulator of the invention, a buoyancy force acting on the water reservoir can be canceled, and flush water in the water reservoir can be circulated with flush water in the flush water tank outside the water reservoir.

DESCRIPTION OF EMBODIMENTS

Next, referring to the attached drawings, we explain a flush water volume regulator according to an embodiment of the present invention, a flush water tank apparatus comprising this flush water volume regulator, and a flush toilet comprising this flush water tank apparatus.

Figure 1:
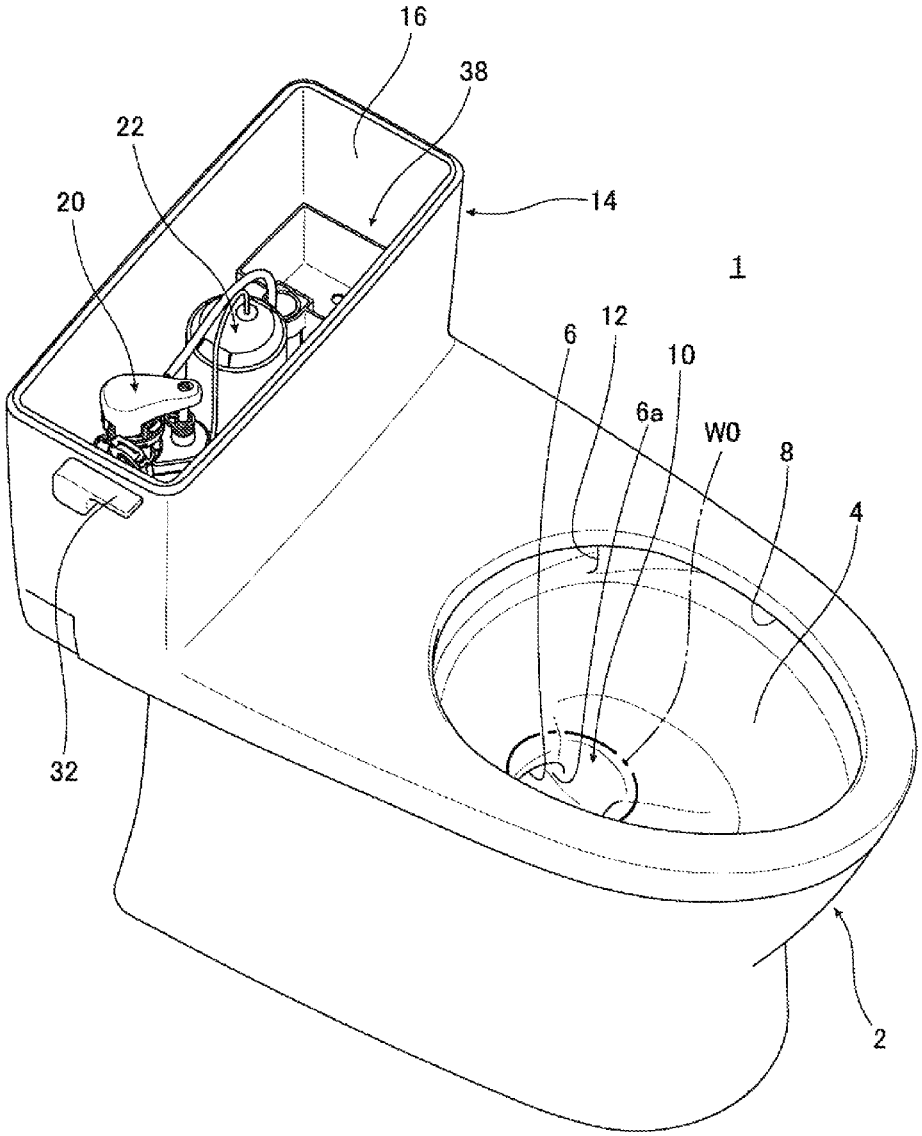
FIG. 1 is a perspective view of a flush toilet in which a flush water tank apparatus comprising a flush water volume regulator according to an embodiment of the present invention is applied, with the toilet seat, toilet cover, and flush water tank apparatus cover body removed.

First, using FIG. 1, we explain a flush toilet applying a flush water tank apparatus comprising a flush water volume regulator according to an embodiment of the present invention.

FIG. 1 is a perspective view of a flush toilet in which a flush water tank apparatus comprising a flush water volume regulator according to an embodiment of the present invention is applied, with the toilet seat, toilet cover, and flush water tank apparatus cover body removed.

As shown in FIG. 1, reference numeral 1 is what is known as a siphon type of flush toilet; this flush toilet 1 comprises a china toilet main unit 2; a bowl portion 4 and discharge trap conduit 6 communicating with the bottom portion of bowl portion 4 are respectively formed on toilet main unit 2. Note that in addition to china, toilet main unit 2 may also be formed of resin and china, or of resin alone.

An inwardly overhanging rim 8 is formed on the top edge portion of the bowl portion 4 of toilet main unit 2, and a first spout port (not shown) for spouting flush water supplied from a water conducting path (not shown) formed in the interior of the rear side of toilet main unit 2 is formed at the left top of toilet main unit 2 bowl portion 4. Flush water spouted from this first spout port (not shown) drops down as it swirls, thereby cleaning bowl portion 4.

A water accumulating portion 10, on which the accumulated water surface is indicated by dot-and-dash line W0, is formed at the bottom of bowl portion 4. A discharge trap conduit 6 inlet 6*a* is opened under said water accumulating portion 10, and discharge trap conduit 6 at the rear is connected through a discharge socket (not shown) from inlet 6*a* to an under-floor discharge pipe (not shown).

A second water spout port 12 for spouting flush water supplied from a water conducting path (not shown) is formed at a position above the accumulated water surface W0 in bowl portion 4. Flush water spouted from this second water spout port 12 creates a swirling current which causes accumulated water in water accumulating portion 10 to swirl up and down.

A flush water tank apparatus 14 is provided on the top surface at the rear side of toilet main unit 2 for holding flush water supplied to toilet main unit 2. The flush water tank apparatus 14 is shown below with the cover body of the flush water tank apparatus removed.

Note that in this embodiment we explain an example in which flush water tank apparatus 14 is applied to the above-described siphon-type flush toilet, but the invention is not limited to such siphon-type flush toilets, and may also be applied to other types of flush toilets such as "wash-down" flush toilets or the like, in which waste is pushed out by the water flow action created by the water drop within the bowl portion.

Figure 2:
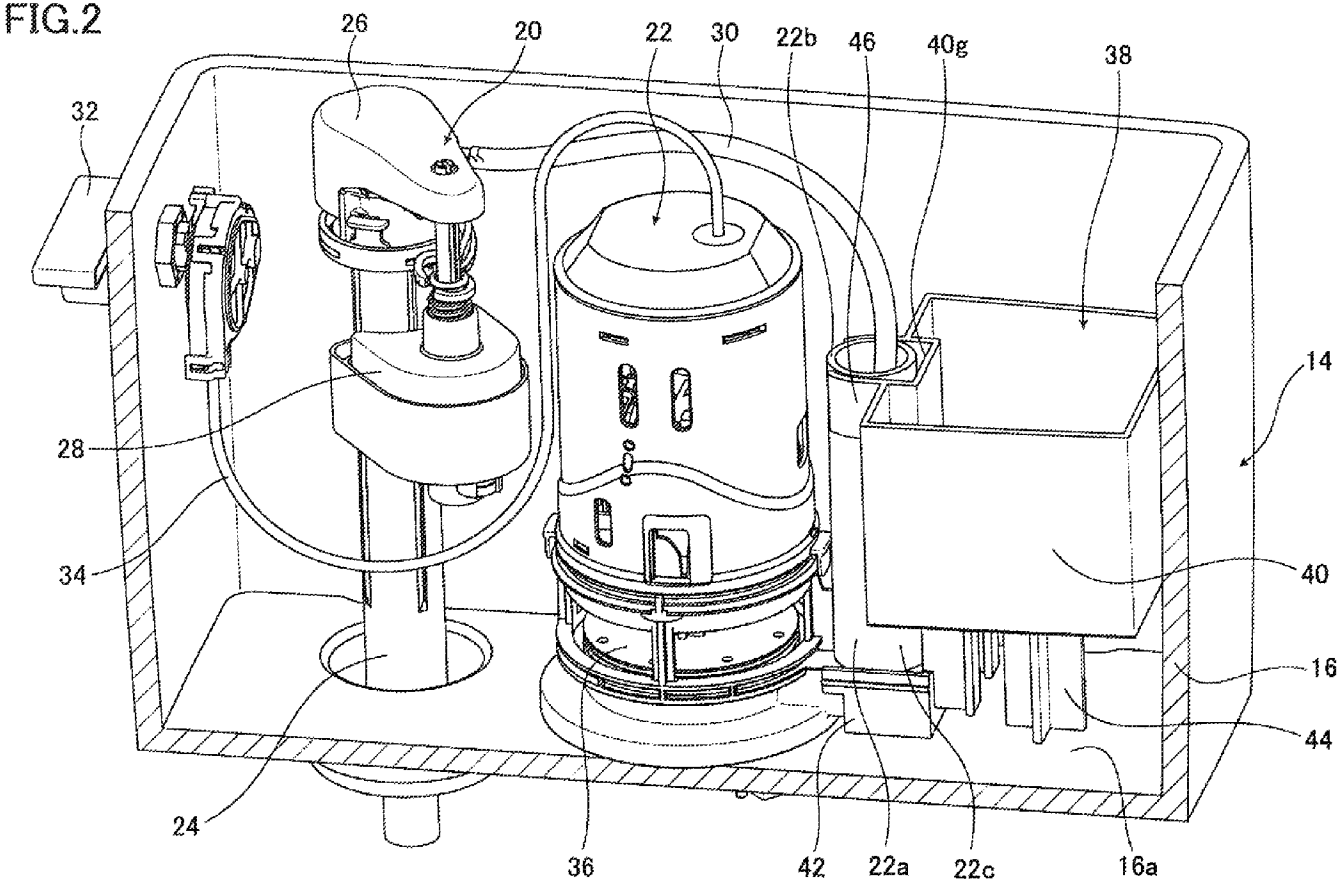
FIG. 2 is a perspective view showing the internal structure of a flush water tank apparatus comprising a flush water volume regulator according to an embodiment of the present invention.
Figure 3:
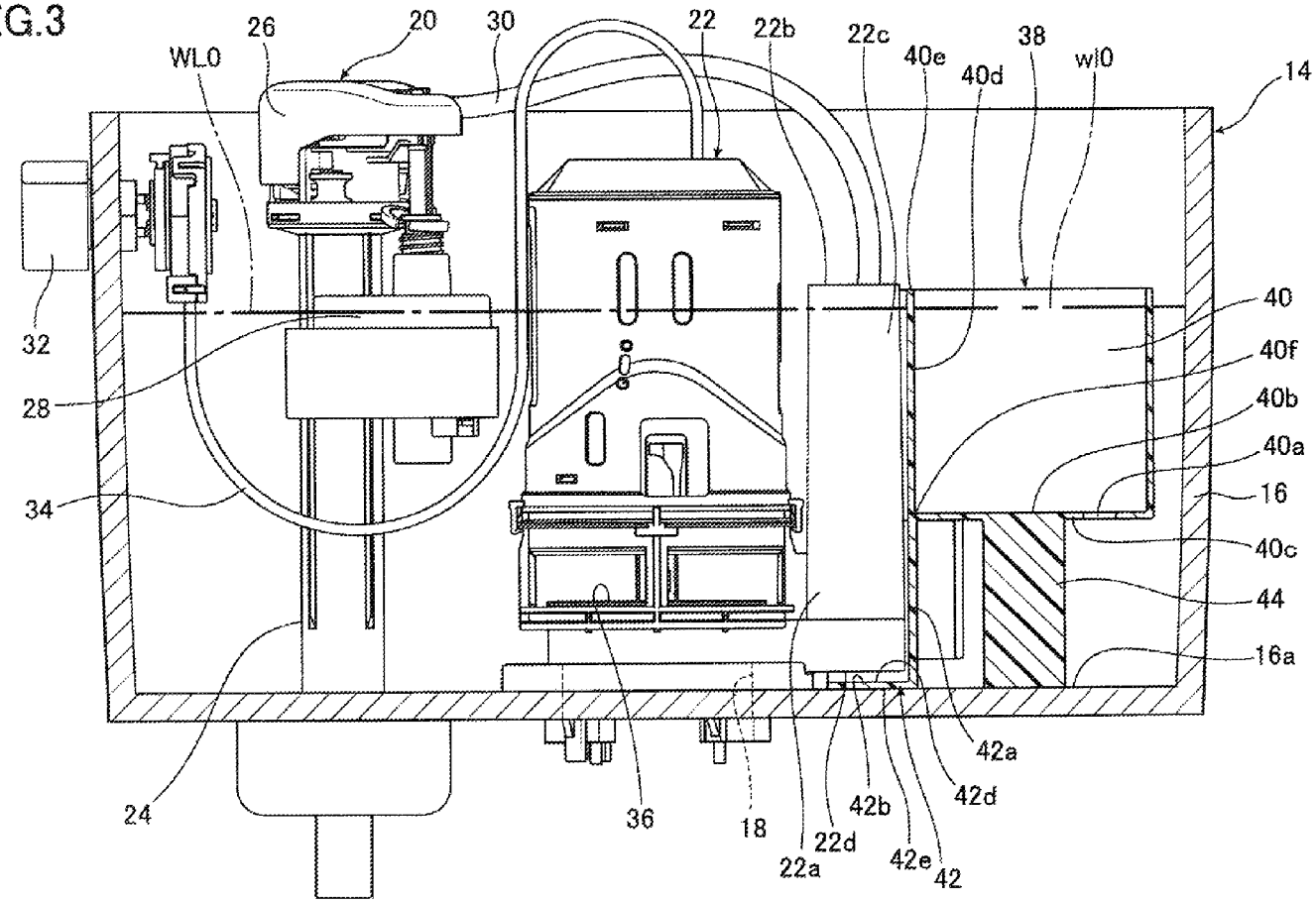
FIG. 3 is a front elevation cross section showing the internal structure of a flush water tank apparatus comprising a flush water volume regulator in a standby state, according to an embodiment of the present invention.

Next, referring to FIGS. 1 through 3, we explain the internal structure of flush water tank apparatus 14.

FIG. 2 is a perspective view showing the internal structure of a flush water tank apparatus comprising a flush water volume regulator according to an embodiment of the present invention; FIG. 3 is a front elevation cross section showing the internal structure of a flush water tank apparatus comprising a flush water volume regulator in a standby state according to an embodiment of the present invention.

Note that in FIG. 3, the expected full water level in the reservoir tank is shown by WL0, and the expected full water level inside the water reservoir is shown by wl0 (in the standby state, the full water level wl0 inside the water reservoir is equal to the reservoir tank full water level WL0).

As shown in FIGS. 1 through 3, flush water tank apparatus 14 comprises a flush water tank 16 for holding flush water for flushing flush toilet 1, and a discharge port 18 communicating with the toilet main unit 2 water conducting path (not shown) is formed on the bottom surface 16*a* of flush water tank 16. Flush water inside flush water tank 16 is supplied to the water conducting path (not shown) in toilet main unit 2. Also, flush water tank 16 is formed so that the amount of stored flush water differs depending on toilet type.

As shown in FIGS. 1 through 3, a flush water supply apparatus 20, being a flush water volume regulator for supplying flush water into flush water tank 16 from a water supply source such as a municipal water supply, and a discharge valve apparatus 22 for opening a discharge port 18 for flush water stored in flush water tank 16 and releasing it to a water conducting path (not shown), are disposed inside flush water tank 16 on flush water tank apparatus 14.

Also, a vertically extending overflow pipe 22*a* is provided on the side of discharge valve apparatus 22, and the downward part inside this overflow pipe 22*a* communicates with discharge port 18. If by some chance the water level inside flush water tank 16 rises above full water level WL0 and reaches the top end opening portion 22*b* of overflow pipe 22*a*, flush water flowing in from the top end opening portion 22*b* on this overflow pipe 22*a* is discharged from discharge port 18 to the water conducting path (not shown) in toilet main unit 2.

More specifically, slightly above the bottom surface 16*a* of flush water tank 16, overflow pipe 22*a* is formed into an L shape extending in a horizontal direction from the bottom of discharge valve apparatus 22, then rising vertically.

Overflow pipe 22*a* has an overflow pipe side 22*c* formed by the outer perimeter of an essentially vertically rising cylinder, and a downward facing surface 22*d* which forms the bottom portion of the bottom end of overflow pipe 22*a*, and extends horizontally above the bottom surface 16*a* of flush water tank 16, and opposes bottom surface 16*a* of flush water tank 16.

Since flush water supply apparatus 20 has the same constitution as a conventional flush water tank apparatus, a specific explanation thereof is here omitted, but it comprises a water supply pipe 24 extending upward from bottom surface 16*a* on flush water tank 16 and connected to an external water supply source, a water supply valve 26 attached on the top end part of the water supply pipe 24 for switching between stopping and spouting water supplied from water supply pipe 24 into flush water tank 16, and a float member 28 for switching between spouting and stopping water from a water supply valve 26 moving up and down in response to fluctuations in the water level inside flush water tank 16.

A water spout port (not shown) is opened on the bottom end portion on the outer circumferential side of water supply pipe 24, and flush water from water supply valve 26 is spouted into flush water tank 16.

In addition, flush water supply apparatus 20 comprises a refill pipe 30 connected to water supply valve 26; the bottom end of this refill pipe 30 is positioned above top end opening portion 22*b* of overflow pipe 22*a* on discharge valve apparatus 22. Makeup water supplied to refill pipe 30 from flush water supply apparatus 20 flows into overflow pipe 22*a* and is refilled as makeup water to toilet main unit 2.

In flush water supply apparatus 20, when flush water inside flush water tank 16 is discharged by discharge valve apparatus 22, described below, the level of flush water drops and float portion 28 falls. This causes water supply valve 26 to open and water to begin spouting from the spout port, thereby starting the spouting into flush water tank 16. Next, as water spouting continues and the water level rises, float portion 28 also rises, causing water supply valve 26 to close, so that the spout port is shut off. This causes the flush water level inside flush water tank 16 to be maintained at a predetermined full water level.

We shall omit a specific explanation of the constitution of discharge valve apparatus 22, since it is similar to that of a conventional discharge valve apparatus, but when the discharge valve body 36 on discharge valve apparatus 22 is lifted by the coupled movement of operating wire 34 linked to operating lever 32 as a result of rotating the operating lever 32 externally attached to flush water tank 16 to execute a predetermined large or small flush mode, discharge port 18 is released for a predetermined time, and a certain quantity of flush water inside flush water tank 16 is discharged into the water conducting path (not shown) of toilet main unit 2.

Figure 4:
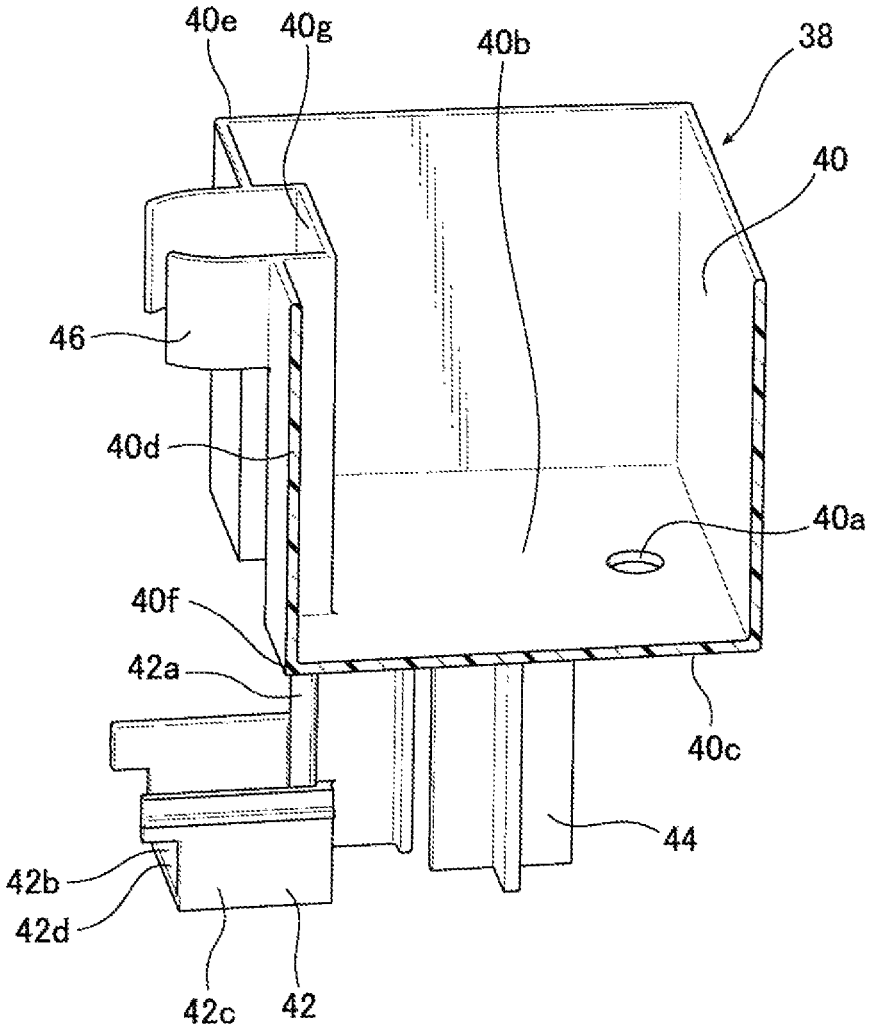
FIG. 4 is a perspective view showing the internal structure of a flush water volume regulator according to an embodiment of the invention.
Figure 5:
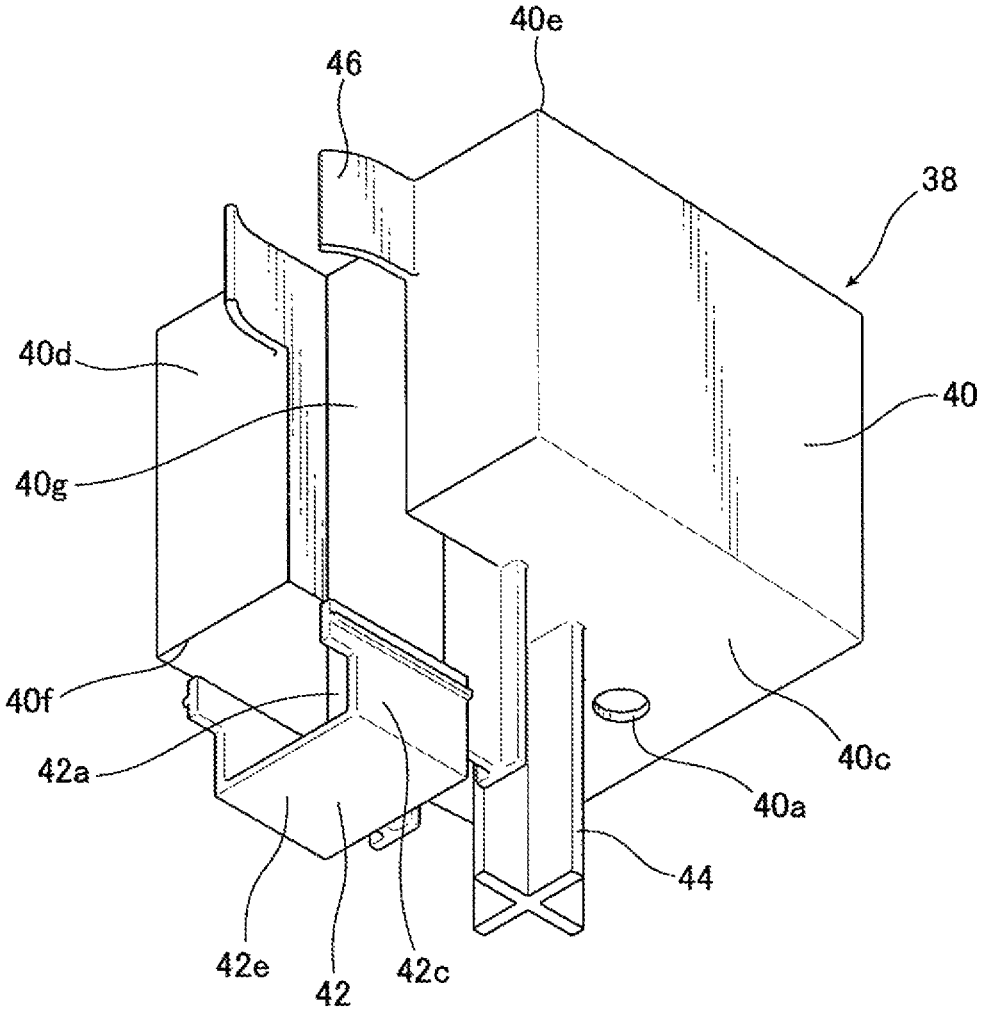
FIG. 5 is a perspective view seen diagonally from below on the front side of a flush water volume regulator according to an embodiment of the present invention.
Figure 6:
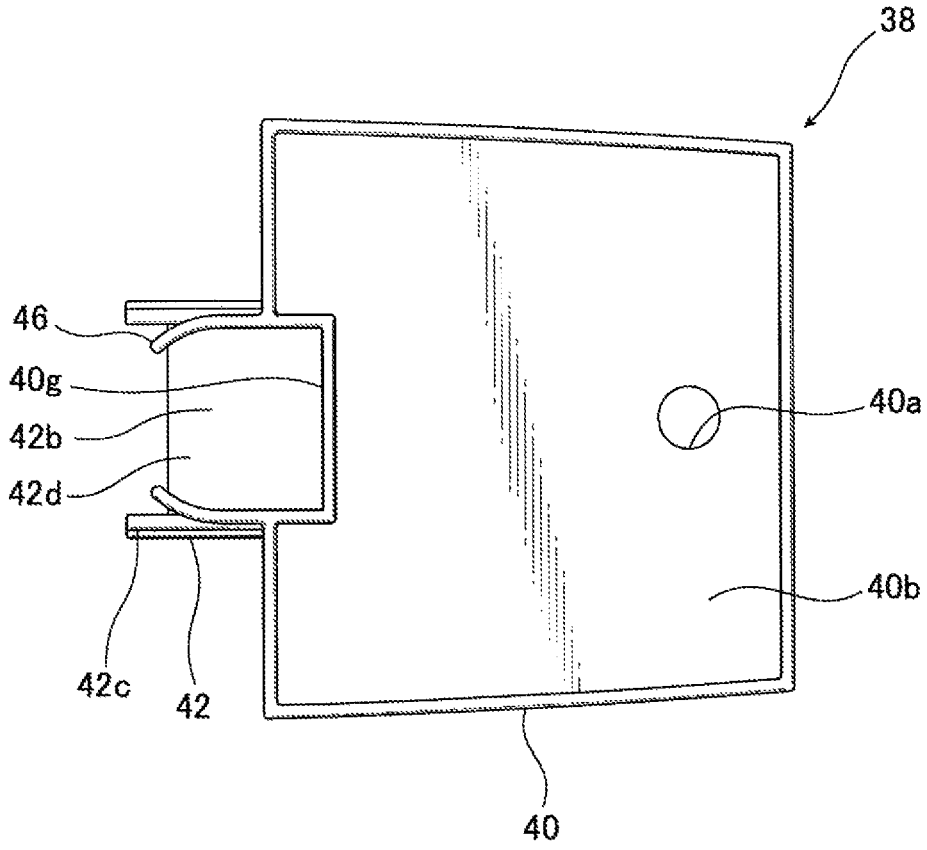
FIG. 6 is a plan view of a flush water volume regulator according to an embodiment of the present invention.

Next, referring to FIGS. 4 through 6, we discuss details of a flush water volume regulator according to an embodiment of the invention.

FIG. 4 is a perspective view showing the internal structure of a flush water volume regulator according to an embodiment of the present invention with a portion of the front side cut away; FIG. 5 is a perspective view of a flush water volume regulator according to an embodiment of the present invention seen from a position diagonally forward and below, and FIG. 6 is a plan view of a flush water volume regulator according to an embodiment of the present invention.

A flush water volume regulator apparatus 38 with which the volume of flush water discharged to a toilet can be adjusted to a desired volume is provided on the flush water tank 16 of flush water tank apparatus 14. The adjustment of flush water volume includes an adjustment by decreasing flush water volume by providing with a flush water volume regulator, as well as an adjustment by increasing flush water volume by changing the size of the flush water volume regulator smaller.

A rectangular parallelepiped box-shaped form open at the top is formed on flush water volume regulator 38, and as shown in FIG. 3, the majority of the bottom side of this box-shaped form is disposed to be submerged in water under full water level WL0 in the standby state prior to the start of flushing. Therefore when flush water tank apparatus 14 performs a flush operation, the flush water volume regulator apparatus 38 can adjust the volume of water in a single flush discharged to toilet main unit 2 by not allowing discharge from flush water tank 16 of the volume of flush water in flush water volume regulator 38 corresponding to approximately the part from the full water level WL0 up to the dead water level DWL.

Thus by installing a flush water volume regulator 38 on a newly manufactured flush water tank apparatus 14, the volume of flush water discharged to toilet main unit 2 can be adjusted to reduce the flush water volume discharged to toilet main unit 2. Moreover, by additionally installing flush water volume regulator 38 on flush water tank apparatus 14, already installed on a toilet or wall, etc., a later adjustment can be made to reduce the volume of flush water discharged to toilet main unit 2.

Flush water volume regulator 38 has: a water reservoir 40, being a water reservoir 40 disposed inside this flush water tank 16, capable of storing a predetermined quantity of flush water, in which an opening 40*a* is formed through which flush water inside water reservoir 40 and flush water outside water reservoir 40 can flow; and a float prevention device 42 extending from water reservoir 40, for activating a force on water reservoir 40 in the opposite direction to that of the buoyancy force produced by flush water in flush water tank 16 on water reservoir 40 when flush water supply apparatus 20 is supplying water into flush water tank 16.

As shown in FIGS. 4 through 6, the opening 40*a* in water reservoir 40 is formed in a cylindrical shape in a portion at the rear side of the bottom surface thereof, extending from inside bottom surface 40*b* to outside bottom surface 40*c* so that the inside and outside of water reservoir 40 are in constant communication. This opening 40*a* is formed on the bottom surface of water reservoir 40 (inside bottom surface 40*b* and outside bottom surface 40*c*), therefore the surface area of inside bottom surface 40*b* and outside bottom surface 40*c* in water reservoir 40 can be reduced by the opening surface area of opening 40*a*, and the buoyancy force acting on water reservoir 40 can be constrained.

The opening 40*a* in water reservoir 40 is not limited to a cylindrical shape; it may also be formed as an ellipse, a square, a slit, or the like, and need only be constantly open so that flush water inside water reservoir 40 can be circulated with flush water inside flush water tank 16 located outside water reservoir 40. For example, opening 40*a* may be formed to have an extremely small opening surface area, or opening 40*a* may have an opening surface area such that the rise speed of the level of flush water supplied by flush water supply apparatus 20 outside water reservoir 40 is essentially the same as the rise speed of the level of flush water inside water reservoir 40.

Water reservoir 40 is formed so that the top edge 40*e* of side surface 40*d* extends approximately 5 mm further up than the expected full water level WL0 in flush water tank 16 during the standby state before starting a flush. Water reservoir 40 is also formed so that the bottom edge 40*f* of side surface 40*d* extends approximately 5 mm below the dead water level DWL (the dead water level when in large flush mode) of flush water inside flush water tank 16 immediately after completion of a flush. Therefore water reservoir 40 is formed so that full water level WL0 and dead water level DWL are positioned on the box-shaped side surface 40*d* thereof.

At the position of the center of gravity on the outside bottom surface 40*c* of water reservoir 40, water reservoir 40 comprises a load support member 44 for supporting the load of water reservoir 40, and a snap fit 46 extending laterally from the side surface 40*d* of water reservoir 40. This load support member 44 forms a support member having a cross-shaped cross section in the horizontal direction, but load support member 44 may also be formed as a partial C-shaped cylindrical cutout of a cylinder, affixed by receiving within it at its bottom end a projection protruding from flush water tank 16. Snap fit 46 is a member capable of attachment so as to sandwich the outer perimeter of overflow pipe 22*a* between snap fit 46 and concave side portion 40*g* formed in side surface 40*d*. This concave side portion 40*g* forms a concave side surface on the side surface 40*d* at the side of overflow pipe 22*a* on water reservoir 40. Flush water volume regulator 38 can be easily attached from the lateral direction to overflow pipe side 22*c* on overflow pipe 22*a* so as to sandwich overflow pipe 22*a* on the inside of snap fit 46.

Float prevention device 42 comprises: a side surface suspended portion 42*a* extending vertically downward from concave side portion 40*g* formed on the side surface 40*d* of water reservoir 40; a top surface-forming portion 42*b* forming a top surface, extending in the horizontal direction from the bottom end of side surface suspended portion 42*a*; and two side wall portions 42*c* rising on both sides of that top surface-forming portion 42*b* and respectively connected to side surface suspended portion 42*a*. Float prevention device 42 is integrally formed with water reservoir 40 in this embodiment, but it may also be formed of a separate member from water reservoir 40, and attached to water reservoir 40.

The side surface suspended portion 42*a* on float prevention device 42 is formed in a flat panel shape extending vertically downward from concave side portion 40*g*, in opposition to overflow pipe side 22*c*. Side surface suspended portion 42*a* is formed from the bottom edge 40*f* of water reservoir 40 below the downward facing surface 22*d* of overflow pipe 22*a* and up to the vicinity of bottom surface 16*a* on flush water tank 16. Side surface suspended portion 42*a* and concave side portion 40*g* form a continuous, flush, side surface portion, and when float prevention device 42 is attached to overflow pipe 22*a*, side surface suspended portion 42*a* and concave side portion 40*g* are in contact so as to follow overflow pipe side 22*c*.

The top surface-forming portion 42*b* of float prevention device 42 forms a top surface portion 42*d* on a horizontally extending flat panel shaped member, and is formed to have a width larger than the pipe diameter of overflow pipe 22*a* so as to cover at least a portion (preferably the majority) of the downward facing surface 22*d* of overflow pipe 22*a* from the lower side. This top surface portion 42*d* is disposed below the downward facing surface 22*d* of overflow pipe 22*a* and above the bottom surface 16*a* of flush water tank 16. Top surface-forming portion 42*b* forms a bottom surface portion 42*e* capable of contacting the bottom surface 16*a* of flush water tank 16 on the rear side of top surface portion 42*d*. Note that between the downward facing surface 22*d* of overflow pipe 22*a* and the bottom surface 16*a* of flush water tank 16, a gap space is formed permitting the attachment and a slight up and down movement of top surface-forming portion 42*b*.

The side wall portions 42*c* on float prevention device 42 are formed to rise up from both ends of top surface portion 42*d*, therefore the cross section formed by top surface portion 42*d* and side wall portions 42*c* has an "U" shape. As a result, side wall portions 42*c*, together with top surface portion 42*d*, are disposed to wrap from the lower side around the downward facing surface 22*d* of overflow pipe 22*a* and the vicinity of the bottom end of overflow pipe 22*a*. Side wall portions 42*c* respectively connect to side surface suspended portion 42*a*, and connect to top surface-forming portion 42*b*, therefore strength against the load acting on top surface-forming portion 42*b* can be increased, and breakage caused by the load received as top surface-forming portion 42*b* seeks to cancel the buoyancy force can be prevented. In addition, side wall portions 42*c* are disposed on both sides in the front to back direction of overflow pipe 22*a*, so lateral offset of float prevention device 42 in the front to back direction relative to overflow pipe 22*a* can be prevented.

Figure 9:
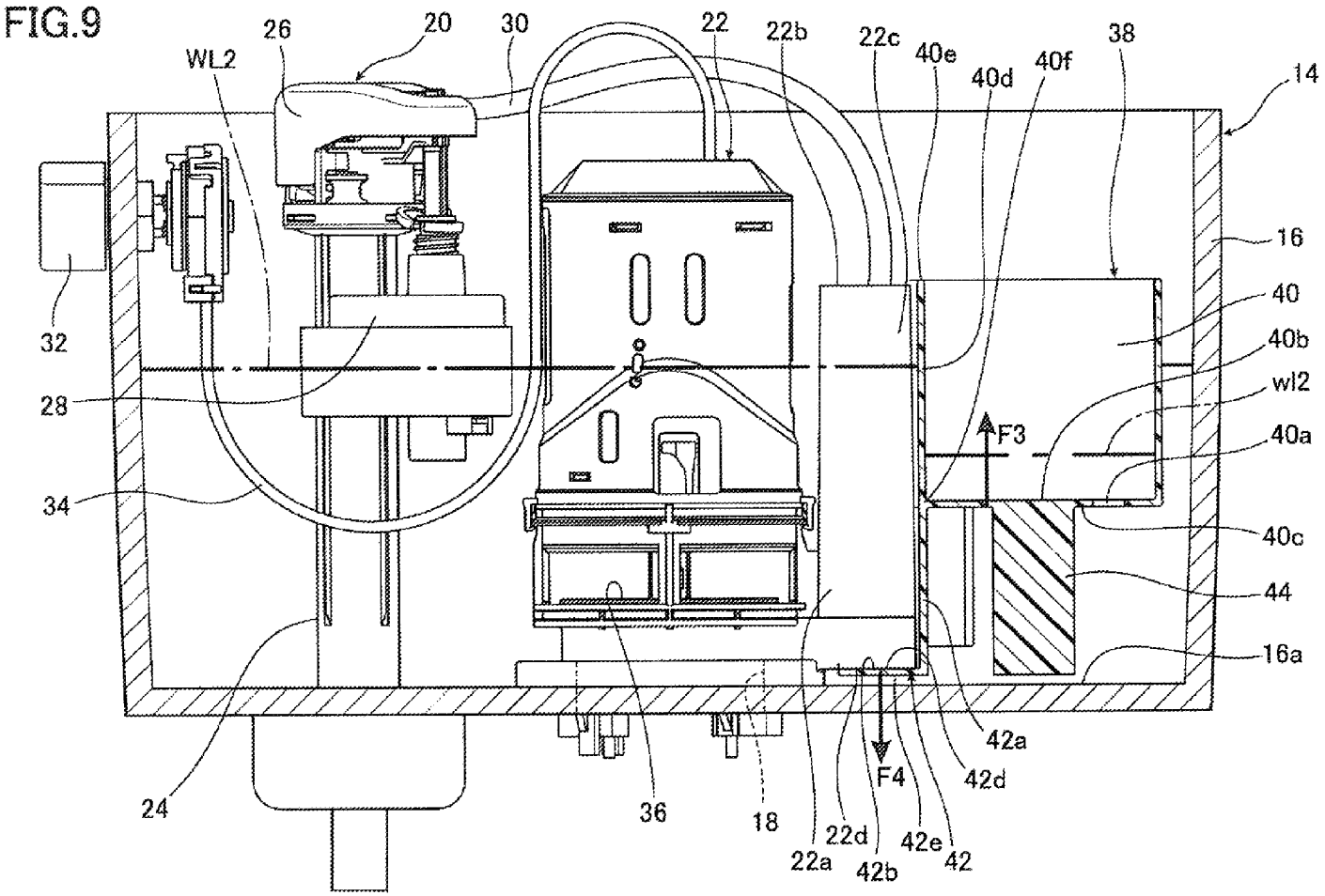
FIG. 9 is a front elevation cross section showing a flush water tank apparatus according to an embodiment of the present invention comprising a flush water volume regulator in the state during which water is being supplied for the first time starting from an empty state in which no flush water has been supplied.

Next, referring to FIGS. 2 and 9, we explain the steps for manufacturing a flush water tank apparatus 14 comprising a flush water volume regulator 38 according to an embodiment of the present invention.

FIG. 9 is a front elevation cross section showing a flush water tank apparatus according to an embodiment of the present invention, comprising a flush water volume regulator in the state when water is being supplied for the first time starting from an empty state in which no flush water has been supplied.

The process for manufacturing a flush water tank apparatus 14 comprising a flush water volume regulator 38 of the present invention has a step for preparing a flush water tank apparatus 14 having a flush water supply apparatus 20 for supplying flush water for flushing toilet main unit 2 from a water source into flush water tank 16, and a discharge valve apparatus 22 disposed on the bottom surface of flush water tank 16 for opening and closing a water conducting path communicating with toilet main unit 2; and a step for attaching flush water volume regulator 38 to flush water tank apparatus 14. Here the step for preparing flush water tank apparatus 14 includes a preparation step so that flush water volume regulator 38 can be attached to a flush water tank apparatus 14 already installed on flush toilet 1 and in use.

Moreover, a flush toilet 1 having a flush water tank apparatus 14 comprising flush water volume regulator 38 can also be manufactured by adding a stage for attaching flush water tank apparatus 14 to flush toilet 1 at any point in time.

In the attachment step above, with the flush water tank apparatus 14 cover in an open state, flush water volume regulator 38 can be easily attached from the side to overflow pipe 22*a*. More specifically, flush water volume regulator 38 can be attached by inserting top surface-forming portion 42*b* on the float prevention device 42 of flush water volume regulator 38, between downward facing surface 22*d* and bottom surface 16*a*, from the side, and embedding snap fit 46 on flush water volume regulator 38 into overflow pipe 22*a* from the side.

Flush water volume regulator 38 has the function of canceling the buoyancy force acting on water reservoir 40, therefore a step for strongly affixing overflow pipe 22*a* or other members to prevent upward flotation can be omitted, and attachment to overflow pipe 22*a* can be easily effected.

Thus flush water volume regulator 38 according to an embodiment of the invention, while enabling simple attachment to flush water tank apparatus 14 so that flush water volume can be regulated to a predetermined volume, is also capable of canceling the buoyancy force acting on water reservoir 40, and of circulating flush water inside water reservoir 40 with flush water in flush water tank 16 outside water reservoir 40.

Next, referring to FIG. 9, we explain the operation of flush water volume regulator 38 on the occasion of the first supplying of water after attaching flush water volume regulator 38 to flush water tank apparatus 14.

After flush water volume regulator 38 is attached to flush water tank apparatus 14, water reservoir 40 is in an empty state with no flush water stored therein prior to first supply of flush water into flush water tank 16. Prior to supplying water, the bottom surface portion 42*e* of float prevention device 42 was brought into contact with the bottom surface 16*a* of flush water tank 16 by the weight of flush water volume regulator 38 itself, and load support member 44 contacted bottom surface 16*a*.

When the supply of water from flush water supply apparatus 20 starts and the water level rises, the water level inside flush water tank 16 rises to water level WL2, and the flush water level inside water reservoir 40 is raised to water level wl2.

The water level of flush water inside water reservoir 40 is raised by flush water flowing in through opening 40*a*, which has a relatively small opening surface area, therefore the speed at which the level of flush water inside water reservoir 40 rises is slower than the speed at which the water level inside flush water tank 16 rises. Water is supplied to water reservoir 40 starting from an empty state, therefore the water level differential between water level WL2 inside flush water tank 16 and flush water level wl2 inside water reservoir 40 is greater than the water level difference between the water level WL1 inside flush water tank 16 during a normal flush, described below, and the water level wl1 of flush water inside water reservoir 40, such that the size of the buoyancy force F3 acting on water reservoir 40 increases even further. Here, in FIG. 9, the buoyancy force acting on water reservoir 40 is exemplified by arrow F3.

Thus when water level WL2 inside flush water tank 16 reaches a position higher than flush water level wl2 inside water reservoir 40, the size of the buoyancy force acting on water reservoir 40 (flush water volume regulator 38) is greater than the weight of flush water volume regulator 38 itself, and flush water volume regulator 38 seeks to move upward due to the buoyancy force.

At this point, the top surface-forming portion 42*b* of float prevention device 42 on flush water volume regulator 38 rises slightly (e.g., approximately 1 mm) in the gap space between downward facing surface 22*d* on overflow pipe 22*a* and bottom surface 16*a* on flush water tank 16, and top surface portion 42*d* on top surface-forming portion 42*b* contacts downward facing surface 22*d*. Top surface portion 42*d* then receives a downward force F4 from the contacting downward facing surface 22*d*. This downward force F4 is opposite in direction to the upward buoyancy force F3 generated by flush water inside flush water tank 16 on water reservoir 40, and acts to cancel the buoyancy force F3 generated at water reservoir 40. Therefore top surface portion 42*d* receives downward force F4, and float prevention device 42 including top surface portion 42*d*, and water reservoir 40 connected to float prevention device 42 receives downward force F4, so that the buoyancy force F3 acting on water reservoir 40 is canceled. As a result, water reservoir 40 is prevented from receiving buoyancy force F3 and floating upward and separating from its attachment position. Thus even when the buoyancy force F3 acting on water reservoir 40 is relatively large, water reservoir 40 connected to float prevention device 42 is prevented by float prevention device 42 from receiving a buoyancy force, floating upward, and separating from the attachment position.

Figure 7:
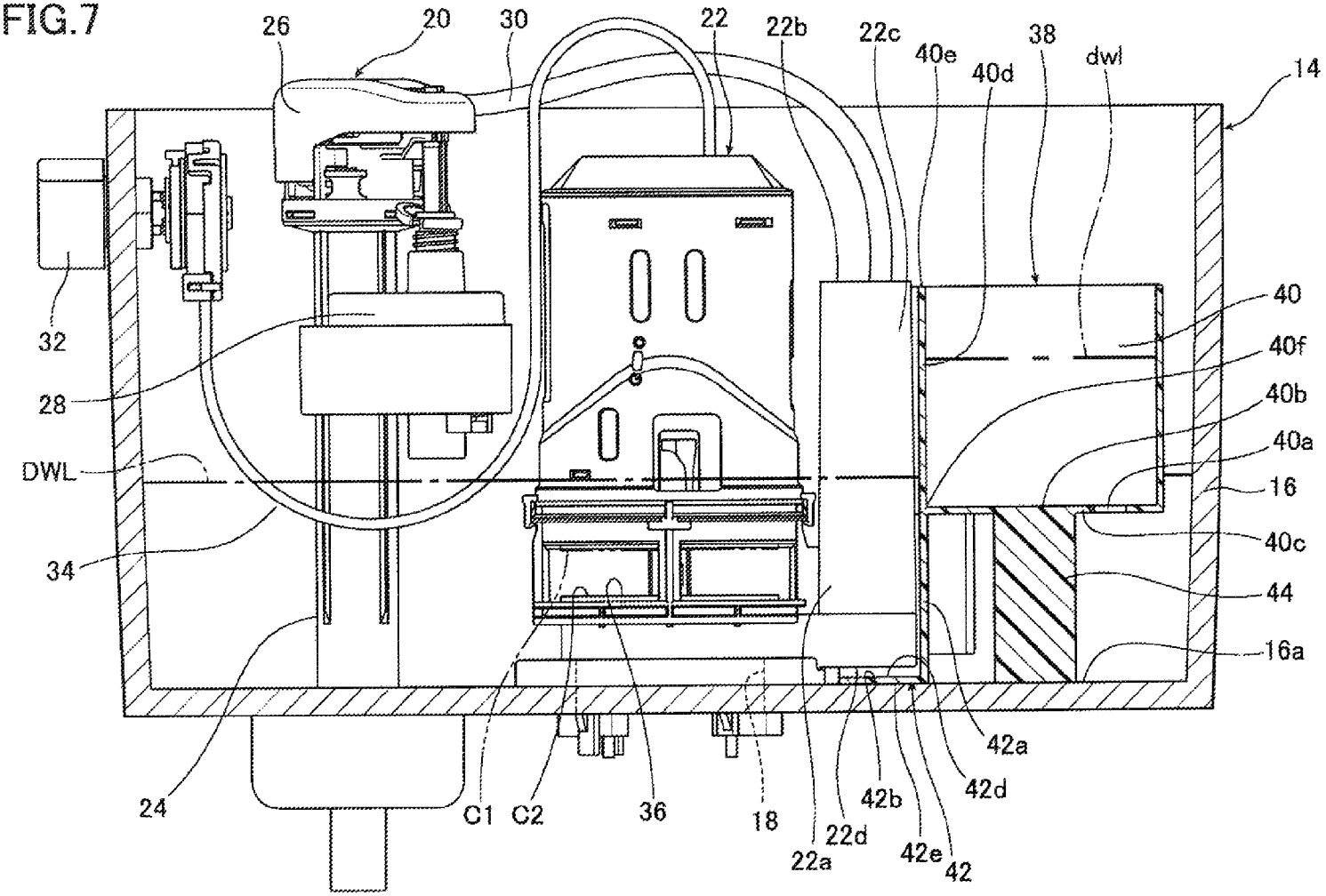
FIG. 7 is a front elevation cross section showing a flush water tank apparatus comprising a flush water volume regulator when the discharge valve has changed from an open state to a closed state during a flush operation, according to an embodiment of the present invention.
Figure 8:
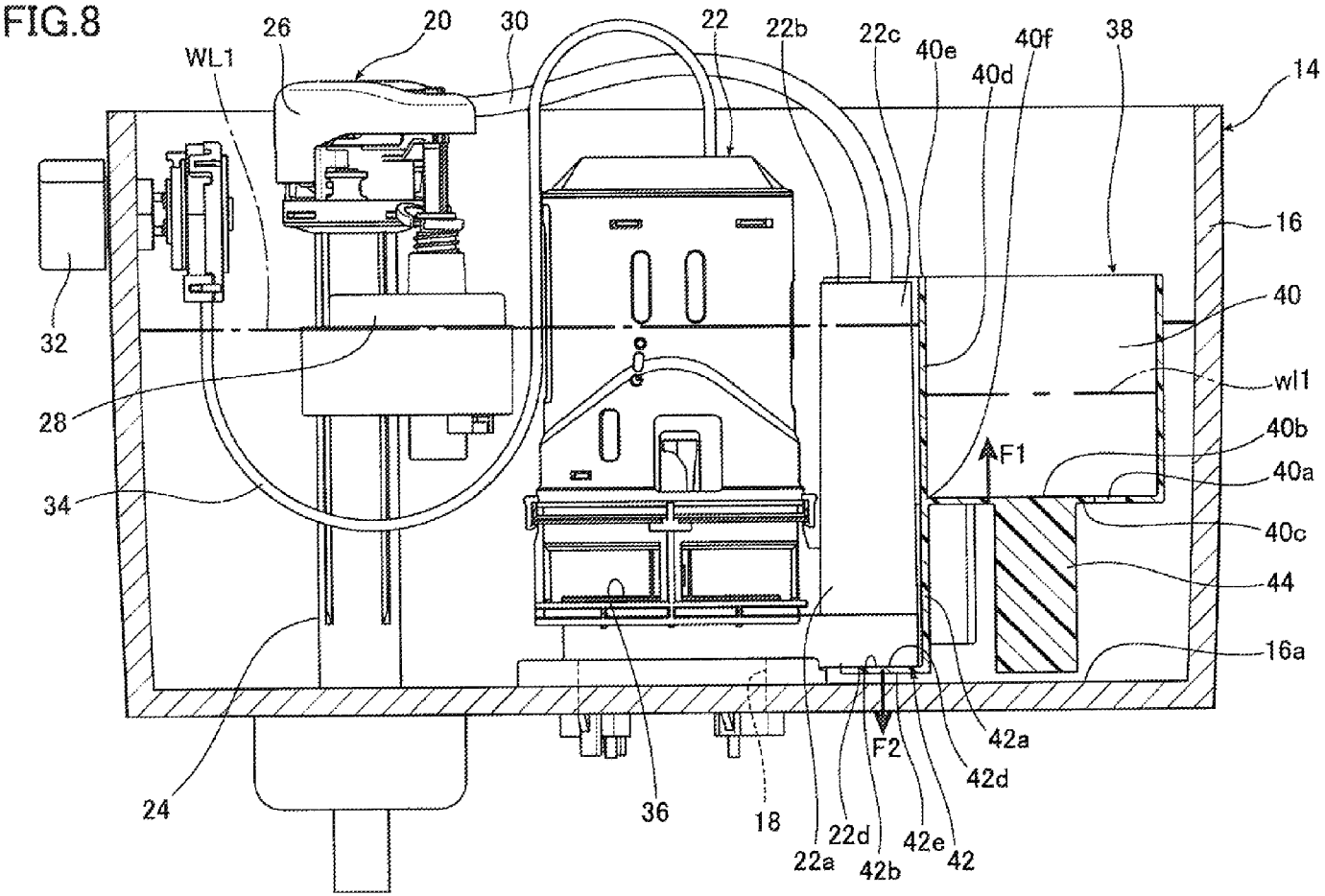
FIG. 8 is a front elevation cross section showing a flush water tank apparatus comprising a flush water volume regulator during supplying of water after the discharge valve has been closed, according to an embodiment of the present invention.

Next, referring to FIG. 3 and FIGS. 7 and 8, we explain the operation (action) of a flush water volume regulator according to an embodiment of the present invention, as well as a flush water tank apparatus comprising this flush water volume regulator, and a flush toilet comprising this flush water tank apparatus.

FIG. 7 is a front elevation cross section of a flush water tank apparatus comprising a flush water volume regulator according to an embodiment of the present invention when the discharge valve has changed from an open valve state to a closed valve state during a flush operation; FIG. 8 is a front elevation cross section of a flush water tank apparatus comprising a flush water volume regulator according to an embodiment of the present invention during supply of water after the discharge valve is closed.

Note that of the two types of flush modes executed by a flush water tank apparatus 14 furnished with a discharge valve apparatus 22 according to an embodiment of the invention, the large flush mode and the small flush mode, other than the greater degree of lifting of discharge valve 36 on discharge valve apparatus 22 by operating wire 34 in the large flush mode than during the small flush mode, the longer time over which discharge port 18 on flush water tank 16 is released, and the lower dead water level DWL (dead water level dwl) during the large flush mode than during the small flush mode, the large flush mode and the small flush mode share basic operations, so we shall explain only the large flush mode.

As shown in FIG. 3, in the standby state prior to beginning the discharge of discharge valve apparatus 22 (prior to start of a flush), discharge valve 36 on discharge valve apparatus 22 is closing discharge port 18, and the initial water level inside flush water tank 16 is at full water level WL0, while the initial water level inside water reservoir 40 is at full water level wl0. Float portion 28 is in a risen state, and flush water supply apparatus 20 water supply valve 26 is in a closed state.

Flush water volume regulator 38 is disposed at a position such that the top edge 40*e* thereof projects from the water's surface, and the initial full water level wl0 of flush water in water reservoir 40 is equal to full water level WL0. As a result of the weight on flush water volume regulator 38 (the weight of flush water volume regulator 38+the weight of flush water inside water reservoir 40), the bottom surface portion 42*e* of float prevention device 42 contacts the bottom surface 16*a* of flush water tank 16, and load support member 44 contacts bottom surface 16*a*.

As a result of opening 40*a*, water reservoir 40 is in a state whereby flush water inside water reservoir 40 can constantly circulate with flush water outside water reservoir 40 in flush water tank 16.

Next, as shown in FIGS. 7 and 8, when a user operates operating lever 32, the flushing operation is started and discharge valve 36 on discharge valve apparatus 22 releases discharge port 18 on flush water tank 16 (in FIG. 7, the state in which discharge valve 36 rises and discharge port 18 is released is shown by imaginary line C1); discharge in the large flush mode to toilet main unit 2 of flush toilet 1 is started by discharge valve apparatus 22 on flush water tank apparatus 14, and the water level inside flush water tank 16 begins to drop.

As shown in FIG. 7, when the water level inside flush water tank 16 begins to drop, flush water inside 40 gradually begins to flow out from the opening 40*a* in water reservoir 40.

When the water level inside flush water tank 16 drops and float portion 28 falls, water supply valve 26 is thereby opened, and spouting of water from the water spouting port begins.

Next, as shown in FIG. 7, when the water level inside flush water tank 16 drops to dead water level DWL, the discharge valve apparatus 22 discharge valve 36 closes the discharge port 18 on flush water tank 16 (in FIG. 7, the state in which discharge valve 36 drops and discharge port 18 is closed is shown by solid line C2). Discharge in the large flush mode to toilet main unit 2 of flush toilet 1 by discharge valve apparatus 22 is thus completed. During this interval, float portion 28 is in a dropped state, water supply valve 26 is opened, and supplying of water to flush water tank 16 by flush water supply apparatus 20 continues, therefore the water level inside flush water tank 16 rises from dead water level DWL.

When the water level inside flush water tank 16 is at dead water level DWL, the level of flush water inside water reservoir 40 is present to dead water level dwl, therefore the buoyancy force acting on water reservoir 40 is relatively small, and is insufficient to cause water reservoir 40 to float upward. At this point a downward load is imposed by the flush water at the dead water level dwl, and water reservoir 40 is supported by load support member 44, and disposed in a stable state.

Up until this point, as a result of the weight on flush water volume regulator 38 itself (the weight of flush water volume regulator 38+the weight of flush water inside water reservoir 40), the bottom surface portion 42*e* of float prevention device 42 contacts the bottom surface 16*a* of flush water tank 16, and load support member 44 contacts bottom surface 16*a*.

As shown in FIG. 8, after the discharge valve 36 on discharge valve apparatus 22 closes discharge port 18 and discharge to toilet main unit 2 is completed, the supply of water from flush water supply apparatus 20 is continued and the water level rises; the water level inside flush water tank 16 rises to water level WL1, and the level of flush water inside water reservoir 40 rises to water level wl1. The water level of flush water inside water reservoir 40 is raised by flush water flowing in through opening 40*a*, which has a relatively small opening surface area, therefore the speed at which the level of flush water inside water reservoir 40 rises is slower than the speed at which the water level inside flush water tank 16 rises.

Thus when water level WL1 inside flush water tank 16 reaches a position higher than flush water level wl1 inside water reservoir 40, the size of the buoyancy force acting on water reservoir 40 (flush water volume regulator 38) is greater than the weight of flush water volume regulator 38 itself, and flush water volume regulator 38 seeks to move vertically upward along overflow pipe side 22*c* due to the buoyancy force of flush water volume regulator 38. Here, in FIG. 8, the buoyancy force acting on water reservoir 40 is exemplified by arrow F1.

At this point, the top surface-forming portion 42*b* of float prevention device 42 on flush water volume regulator 38 rises slightly (e.g., approximately 1 mm) in the gap space between downward facing surface 22*d* on overflow pipe 22*a* and bottom surface 16*a* on flush water tank 16, and top surface portion 42*d* on top surface-forming portion 42*b* contacts downward facing surface 22*d* and is caught. Top surface portion 42*d* then receives a downward force F2 from the contacting downward facing surface 22*d*. This downward force F2 is opposite in direction to the upward buoyancy force F1 generated by flush water inside flush water tank 16 on water reservoir 40, and acts to cancel the buoyancy force F1 generated at water reservoir 40. Therefore top surface portion 42*d* receives a downward force F2, float prevention device 42 including top surface portion 42*d* and water reservoir 40 connected to float prevention device 42 receives a downward force F2, and buoyancy force F1 acting on water reservoir 40 is canceled, so that water reservoir 40 is prevented from receiving a buoyancy force F1 and rising up to separate from the attachment position. Thus irrespective of the degree of the buoyancy force F1 acting on water reservoir 40, water reservoir 40 connected to float prevention device 42 is prevented by float prevention device 42 from receiving a buoyancy force, floating upward, and separating from the attachment position.

In addition, when the supply of water from flush water supply apparatus 20 is continued and the water level rises, float portion 28 also rises, causing water supply valve 26 to close, thereby closing the water spouting port. By this means the level of flush water inside flush water tank 16 is maintained at a predetermined full water level WL0. Flush water inside water reservoir 40 and flush water inside flush water tank 16 and outside water reservoir 40 flow through opening 40*a*, therefore the water level inside water reservoir 40 ultimately also reaches full water level wl0.

When flush water flows into water reservoir 40 from opening 40*a* and the water level differential between the flush water level inside water reservoir 40 and the flush water level inside flush water tank 16 and outside water reservoir 40 essentially disappears, the buoyancy force acting on water reservoir 40 becomes relatively small. Therefore flush water volume regulator 38 seeks to move downward due to the flush water volume regulator 38's own weight, (the weight of flush water volume regulator 38+the weight of flush water inside water reservoir 40). The top surface-forming portion 42*b* of float prevention device 42 on flush water volume regulator 38 drops slightly (e.g., approximately 1 mm) in the gap space between downward facing surface 22*d* on overflow pipe 22*a* and bottom surface 16*a* on flush water tank 16, and bottom surface portion 42*e* on top surface-forming portion 42*b* contacts bottom surface 16*a*.

When the level of flush water inside flush water tank 16 reaches the full water level and water supply valve 26 closes, the series of flush operations by flush water tank apparatus 14 is completed, and the apparatus returns to a standby state.

According to the flush water volume regulator 38 according to an embodiment of the present invention, when flush water supply apparatus 20 is supplying water into flush water tank 16, float prevention device 42 can generate a force on water reservoir 40 opposite in direction to the force generated by flush water inside flush water tank 16 on water reservoir 40, thereby canceling the buoyancy force acting on water reservoir 40. Therefore the problem whereby water reservoir 40 receives a buoyancy force and separates from its attachment position can be prevented. Also, in the present invention the opening 40*a* formed in water reservoir 40 is constantly released, therefore flush water inside water reservoir 40 and flush water inside flush water tank 16 located outside water reservoir 40 can be circulated so that flush water in water reservoir 40 does not become stagnant. The present invention can thus provide a flush water volume regulator 38 capable of canceling the buoyancy force acting on water reservoir 40, and flush water in water reservoir 40 can be circulated with flush water in flush water tank 16 outside water reservoir 40.

According to flush water volume regulator 38 according to the present invention, when flush water supply apparatus 20 is supplying water into flush water tank 16, the downward facing surface of the existing flush water supply apparatus 20 or discharge valve apparatus 22 can contact the top surface portion 42*d* of float prevention device 42 disposed to extend from water reservoir 40, thereby enabling the buoyancy force acting on water reservoir 40 to be canceled. Therefore the problem whereby water reservoir 40 floats upward and separates from its attachment position can be prevented by a relatively simple structure, without providing any special members. Also, in the present invention the opening 40*a* formed in water reservoir 40 is constantly released, so flush water in water reservoir 40 can be circulated with flush water inside flush water tank 16 located outside water reservoir 40. Therefore the present invention can provide a flush water volume regulator 38 capable of canceling the buoyancy force acting on water reservoir 40, and flush water in water reservoir 40 can be circulated with flush water in flush water tank 16 outside water reservoir 40.

Furthermore, according to the flush water volume regulator 38 according to the present embodiment, the dead space between the downward facing surface 22*d* on overflow pipe 22*a* and the bottom surface 16*a* on flush water tank 16 can be utilized to efficiently dispose float prevention device 42 within the limited space inside flush water tank 16. When flush water supply apparatus 20 is supplying water into flush water tank 16, downward facing surface 22*d* on overflow pipe 22*a* can contact top surface portion 42*d* on float prevention device 42, installed so as to extend from water reservoir 40. The buoyancy force acting on water reservoir 40 can thus be canceled, and the problem whereby water reservoir 40 floats up and separates from its attachment position can be reliably prevented.

Also, according to flush water volume regulator 38 according to the present embodiment, float prevention device 42 comprises side wall portions 42*c* rising from both sides of top surface portion 42*d*, and the cross section formed by top surface portion 42*d* and side wall portions 42*c* is formed into an "U" shape. Therefore strength against loads acting on float prevention device 42 can be increased, and sideways movement of float prevention device 42 relative to overflow pipe 22*a* can be prevented.

Also, according to flush water volume regulator 38 according the present embodiment, load support member 44 supports the load of water reservoir 40, stably supporting water reservoir 40, and water reservoir 40 is disposed with its own concave side portion 40*g* in contact with side 22*c* of overflow pipe 22*a*. Therefore water reservoir 40 can be stably affixed even when there are undulations of flush water inside flush water tank 16.

Also, according to flush water volume regulator 38 according to the present embodiment, an opening 40*a* is formed in the inside bottom surface 40*b* of water reservoir 40. Therefore the surface area of inside bottom surface 40*b* can be reduced, the buoyancy force acting on water reservoir 40 can be constrained, and the problem of the water reservoir being subjected to a buoyancy force causing it to float upward and separate from its attachment position can be prevented.

Also, according to flush water volume regulator 38 according to the embodiment, the top edge 40*e* of side surface 40*d* on water reservoir 40 is positioned a predetermined distance above the expected full water level WL0, and the bottom edge 40*f* of side surface 40*d* on water reservoir 40 is positioned a predetermined distance below the expected dead water level DWL. Therefore even if the full water level fluctuates up and down, that full water level is disposed between the top edge 40*e* and bottom edge 40*f* of the side surface 40*d* of water reservoir 40, and even if the dead water level fluctuates up and down, that dead water level is disposed between the top edge 40*e* and bottom edge 40*f* of the side surface 40*d* of water reservoir 40. Hence the present invention enables reliable regulation of the expected volume of flush water.

According to the flush water volume regulator 38 of the present embodiment, a flush water tank apparatus 14 can be provided comprising a flush water volume regulator 38 with which the buoyancy force acting on water reservoir 40 can be canceled, and the flush water inside water reservoir 40 can be circulated with flush water inside flush water tank 16 located outside water reservoir 40.

In addition, according to the flush water volume regulator 38 of the present embodiment, a flush toilet 1 can be provided having a flush water tank apparatus 14 comprising a flush water volume regulator 38 with which the buoyancy force acting on water reservoir 40 can be canceled, and the flush water inside water reservoir 40 can be circulated with flush water inside flush water tank 16 located outside water reservoir 40.

What is claimed is:

1. A flush water volume regulator capable of regulating the volume of flush water discharged to a toilet, disposed on a flush water tank apparatus having a water supply apparatus supplying water into a flush water tank from a water source for flushing a toilet, and a discharge valve apparatus for opening and closing a discharge flow path, disposed on the bottom surface of a flush water tank and communicating with a toilet; the flush water volume regulator comprising:

a water reservoir disposed inside this flush water tank and capable of storing a predetermined quantity of flush water, in which an opening is formed through which flush water in the water reservoir and flush water outside the water reservoir can flow; and a float prevention device configured to cause a force to act on the water reservoir opposite in direction to a buoyancy force generated by flush water inside the flush water tank on the water reservoir when the water supply apparatus is supplying water into the flush water tank and, wherein the float prevention device includes a contacting surface configured to extend from the water reservoir so as to be capable of contacting a downward facing surface of the discharge valve apparatus.

2. The flush water volume regulator of claim 1, wherein the discharge valve apparatus includes an overflow pipe configured to discharge flush water to the discharge flow path when flush water held in the flush water tank exceeds the full water level; and the contacting surface of the float prevention device is disposed so as to be capable of contacting the downward facing surface of the overflow pipe between the downward facing surface of the overflow pipe and the bottom surface of the flush water tank.

3. The flush water volume regulator of claim 2, wherein the float prevention device includes side wall portions rising up from both sides of the contacting surface, and the cross section formed by the contacting surface and the side wall portions is shaped as a "U".

4. The flush water volume regulator of claim 3, wherein the water reservoir includes a load supporting member configured to support the load of the water reservoir at the position of the center of gravity on the bottom surface of the water reservoir, and the water reservoir is disposed so that its side surface is in contact with the side surface of the overflow pipe.

5. The flush water volume regulator of claim 1, wherein the water reservoir forms an opening in the bottom surface of the water reservoir.

6. The flush water volume regulator of claim 1, wherein the top edge of the side surface of the water reservoir is positioned a predetermined distance above the expected full water level inside the flush water tank in a standby state before a flush is started, and the bottom edge of the side surface of the water reservoir is positioned a predetermined distance below the expected dead water level of flush water inside the flush water tank immediately after completion of a flush.

7. A flush water tank apparatus comprising the flush water volume regulator of claim 1.

8. A flush toilet comprising the flush water tank apparatus of claim 7.

* * * * *